US010717616B2

(12) United States Patent
Cardillo

(10) Patent No.: US 10,717,616 B2
(45) Date of Patent: Jul. 21, 2020

(54) REGISTER, A PROCESSING MACHINE AND A METHOD FOR PLACING PLATE-LIKE ELEMENTS

(71) Applicant: BOBST MEX SA, Mex (CH)

(72) Inventor: Marco Cardillo, Lausanne (CH)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 16/098,583

(22) PCT Filed: May 10, 2017

(86) PCT No.: PCT/EP2017/025117
§ 371 (c)(1),
(2) Date: Nov. 2, 2018

(87) PCT Pub. No.: WO2017/202498
PCT Pub. Date: Nov. 30, 2017

(65) Prior Publication Data

US 2019/0144224 A1 May 16, 2019

(30) Foreign Application Priority Data

May 24, 2016 (EP) ..... 16020186

(51) Int. Cl.
*B65H 3/08* (2006.01)
*B65H 5/08* (2006.01)
(Continued)

(52) U.S. Cl.
CPC ..... *B65H 3/0816* (2013.01); *B65H 3/085* (2013.01); *B65H 5/085* (2013.01); *B65H 5/10* (2013.01);
(Continued)

(58) Field of Classification Search
CPC ..... B65H 3/08; B65H 3/0808; B65H 3/0816; B65H 3/085; B65H 5/08; B65H 5/085;
(Continued)

(56) References Cited

U.S. PATENT DOCUMENTS

2007/0093370 A1* 4/2007 Chiari ..... B65H 29/044 493/22
2012/0118703 A1* 5/2012 Rebeaud ..... B65H 7/08 198/464.4

FOREIGN PATENT DOCUMENTS

EP 1 044 908 A1 10/2000
EP 2 058 251 A2 5/2009
(Continued)

OTHER PUBLICATIONS

International Search Report dated Jul. 21, 2017 in corresponding PCT International Application No. PCT/EP2017/025117.
(Continued)

*Primary Examiner* — Prasad V Gokhale
(74) *Attorney, Agent, or Firm* — Ostrolenk Faber LLP

(57) ABSTRACT

A register (20; 60) for a processing machine (1) for processing plate-like elements (10) includes a gripping element (21; 22) for placing the plate-like elements (10) in a gripper bar (31) of a conveyor (30) of a processing machine (1) conveying the plate-like elements (10) in a longitudinal direction, an actuator module (201, 202) to drive the gripping element (21; 22), at least one front correction sensor module (7) configured to measure the front position of register marks (12*a*) printed on a front section of the plate-like element (10) grasped by the gripping element (21; 22). The register (20; 60) includes at least one front pre-correction sensor module (80), placed upstream of the front correction sensor module (7) in the longitudinal direction, the front pre-correction sensor module (80) is configured: to detect the passage of a front transversel edge of the plate-like
(Continued)

element (10) in at least two longitudinally spaced lateral axis of detection (P1, P2), one located in front of the other, and to provide measurements to a computation and control unit (40) of the processing machine (1) that is configured: to control the actuator module (201, 202) in order to move the gripping element (21; 22) toward the gripper bar (31) and to activate the gripping element (21; 22) in order to grasp a plate-like element (10). Also a processing machine for processing plate-like elements includes the register. A method for placing plate-like elements within a processing machine is disclosed.

10 Claims, 5 Drawing Sheets

(51) Int. Cl.

| | |
|---|---|
| ***B65H 5/10*** | (2006.01) |
| ***B65H 7/08*** | (2006.01) |
| ***B65H 7/10*** | (2006.01) |
| ***B65H 7/14*** | (2006.01) |
| ***B65H 9/10*** | (2006.01) |
| ***B65H 9/12*** | (2006.01) |

(52) U.S. Cl.

CPC ..... *B65H 7/08* (2013.01); *B65H 7/10* (2013.01); *B65H 7/14* (2013.01); *B65H 9/105* (2013.01); *B65H 9/12* (2013.01); *B65H 2511/20* (2013.01); *B65H 2511/214* (2013.01); *B65H 2511/24* (2013.01); *B65H 2511/242* (2013.01); *B65H 2511/512* (2013.01); *B65H 2701/1311* (2013.01); *B65H 2701/1315* (2013.01); *B65H 2701/176* (2013.01); *B65H 2801/42* (2013.01)

(58) Field of Classification Search

CPC ... B65H 5/10; B65H 7/00; B65H 7/02; B65H 7/06; B65H 7/08; B65H 7/10; B65H 7/14; B65H 7/20; B65H 9/00; B65H 9/105; B65H 9/12; B65H 2511/20; B65H 2511/214; B65H 2511/24; B65H 2511/242; B65H 2511/512; B65H 2701/1311; B65H 2701/1315; B65H 2701/176

See application file for complete search history.

(56) References Cited

FOREIGN PATENT DOCUMENTS

| | | |
|---|---|---|
| EP | 2 407 402 A2 | 1/2012 |
| WO | WO 2011/009567 A1 | 1/2011 |

OTHER PUBLICATIONS

Written Opinion dated Jul. 21, 2017 in corresponding PCT International Application No. PCT/EP2017/025117.

* cited by examiner

REGISTER, A PROCESSING MACHINE AND A METHOD FOR PLACING PLATE-LIKE ELEMENTS

CROSS-REFERENCE TO RELATED APPLICATIONS

The present application is a 35 U.S.C. §§ 371 national phase conversion of PCT/EP2017/025117, filed May 10, 2017, which claims priority of European Patent Application No. 16020186.9, filed May 24, 2016, the contents of which are incorporated by reference herein. The PCT International Application was published in the English language.

TECHNICAL FIELD

The present invention refers to a register for a processing machine and to a processing machine for processing plate-like elements comprising said register and a method for placing plate-like elements within a processing machine.

TECHNICAL BACKGROUND

Such processing machines are used notably in the printing and packaging industry, for example, for making cardboard boxes from plate-like elements, such as pre-printed cardboard sheets. In a feeder station, these sheets are taken from a stack located upstream of the machine and are then placed in gripper bars mounted at regular intervals between two lines of chains. The gripper bars and chains makes it possible to convey the sheets into the various subsequent processing stations of the machine. Typically, such stations are devoted to the punching of the sheets, to the ejection of the punching wastes and to the reception in a stack of these punched sheets.

In a paced flow, the lines of chains move and stop periodically so that, during each movement, all the gripper bars engaged with a sheet are moved from one station to the adjacent downstream station. To obtain a quality printing or converting operation, the placement of the sheets within the various successive stations is crucial. In punching a printed sheet, sheet placement in the punching station must be accurate. Specifically, care should be taken that tools used for the punching, for example the punching form of a platen press, are in perfect register with the printing that has been previously done on the sheet.

The document EP 1,044,908 relates to a device and a method for placing plate-like elements in a feeder station. In this method are applied the successive steps consisting in, during the advancement of each plate-like element, activating the gripping element in order to grasp the plate-like element, then measuring the longitudinal placement error, the transverse placement error and the angular placement error of the plate-like element attached to the feeder, relative to a theoretical position, by detecting register marks printed on the plate-like element by first sensors, and finally controlling the gripping element according to the placement errors of the plate-like element to which it is attached.

The device and the method described in this document operates remarkably well and has made it possible to considerably increase the production rates of the processing machines by carrying out the measurements on the fly and the corrections of placement of each plate-like element, without the necessity to stop the plate-like element. Nevertheless, when a plate-like element is very much advanced or when it is very askew, the gripping element may hold the plate-like element on a printed portion instead of the front waste section. There is a risk of damaging the print and the structure of the plate-like element in an area outside the front waste section.

The document WO2011/009567 discloses an improved processing machine, comprising two additional second sensors, placed upstream of the first sensors. In a first step, the two additional second sensors are capable of detecting the passage of a transverse edge of the plate-like element, when the latter is moving, but before it is seized on the fly by the gripping element. Thanks to the measurements of the two second sensors, the position of the gripping element is pre-corrected in order to be well positioned in parallel to the front transverse edge of the plate-like element before grasping it. In a second step, the longitudinal, transverse and lateral placement errors of the plate-like element grasped by the gripping element are measured by the first sensors, by detecting register marks printed on the plate-like element. The gripping element is then controlled according to the placement errors of the plate-like element to which it is attached. The risk of damaging the print and the structure of the plate-like element in an area outside the front waste section can thus be avoided. This method makes it possible to correct placement errors that are more serious and therefore to reduce the risk of machine stoppage associated with an out-of-tolerance placement error of a plate-like element. Generally, the method makes it possible to recover advance or delay of most of the plate-like elements without machine stoppage.

However, it is still not possible to recover a very large delay of the plate-like element, typically when the shift of the plate-like element is higher than 6 mm with respect to the theoretical position. In this case, the plate-like element edge is detected too late and it cannot be rectified. Indeed, with machine speeds in the order of 12,000 sheets/hour, although a theoretical trajectory can be estimated to control the gripping element to bring the plate-like element in time, the accelerations needed to achieve this are too important and cannot be implemented. Such accelerations would involve too important vibrations of the gripping element that could not be stopped in an accurate position, in particular due to the masses that have to be moved and because of the very high precision that is required.

A simple solution to reduce the accelerations of the gripping element could be to anticipate its movements by simply moving the additional second sensors at a most upstream location. However, the plate-like elements that arrive in the gripping element with an important advance could not be detected by these most upstream positioned second sensors. Indeed, the front transverse edge of the advance plate-like element will be covered by the plate-like element located upstream, already taken by the gripper bar and just leaving the place. The front transverse edge of the plate-like element will thus be hidden by the plate-like element located upstream when the second sensors will try to detect it.

Another simple solution could be to detect the passage of the rear edge of the plate-like element as it would not be hidden by the preceding sheet. The machine would thus be informed soon enough to trigger the start of the gripping element in advance, allowing limiting the needed accelerations for catching up the delay. This may be suitable for plate-like elements of high thicknesses, approximately greater than four or five millimeters. Indeed, sensors commercially available are able to detect variations of thicknesses that are representative of the passage of a sheet. However, they are not able to detect smaller thickness with sufficiently accuracy or they are too expensive.

SUMMARY OF THE INVENTION

One object of the present invention is to remedy the aforementioned drawbacks. The invention can thus makes it possible to correct placement errors that are higher than +/−6 mm, and therefore to reduce the risk of machine stoppage associated with an out-of-tolerance placement error of a plate-like element.

To this end, one subject of the invention is a register for a processing machine for processing plate-like elements comprising:

- a gripping element for placing the plate-like elements in a gripper bar of a conveyor of a processing machine conveying the plate-like elements in a longitudinal direction,
- an actuator module adapted to drive the gripping element,
- at least one front correction sensor module configured to measure the front position of register marks printed on a front section of the plate-like element grasped by the gripping element,
- and the register further comprises:
- at least one front pre-correction sensor module, placed upstream of the front correction sensor module in the longitudinal direction, the front pre-correction sensor module being configured:
  - to detect the passage of a front transverse edge of the plate-like element in at least two longitudinally spaced lateral axis of detection, one located in front of the other, and
  - to provide measurements to a computation and control unit of the processing machine that is configured:
    - to control the actuator module in order to move the gripping element toward the gripper bar and
    - to activate the gripping element in order to grasp a plate-like element.

Therefore, the front pre-correction sensor module is adapted to detect the passage of a front transverse edge of the plate-like element in advance in a hole of plate-like elements, for a plate-like element being late, in time or in advance. In all cases, the plate-like element can be detected earlier to start the gripping element in order to place it parallel to the plate-like element, on the fly, before grasping the plate-like element. It allows detecting the plate-like element early enough to avoid excessive accelerations and vibrations of the gripping element.

Then, in a second step, the three placement errors of the plate-like element grasped by the gripping element can be measured by detecting register marks printed on the plate-like element by the front correction sensor module and by the lateral correction sensor in order to correct these placement errors to ensure a perfect placement of the front transverse edge of the plate-like element in the gripper bar.

According to one or more features of the register, taken alone or in combination:

- the distance between the first lateral axis of detection and the second lateral axis of detection longitudinally spaced, with one in front of the other, is comprised between 2 mm and 30 mm,
- the front pre-correction sensor comprises:
  - at least a first front pre-correction sensor placed upstream of the front correction sensor module in the longitudinal direction,
  - at least a second front pre-correction sensor being placed upstream of the first front pre-correction sensor in the longitudinal direction,
- the first front pre-correction sensor comprises a least a pair of first front pre-correction sensors aligned along the lateral direction and spaced from one another,
- the second front pre-correction sensor comprises at least a pair of second front pre-correction sensors aligned along the lateral direction and spaced from one another,
- the pre-correction sensor comprises at least one optical sensor including at least one light beam receiver,
- the actuator module comprises:
  - a lateral actuator configured to drive the gripping element along a lateral direction relative to the longitudinal direction; and
  - two longitudinal actuators spaced between them in the lateral direction, each longitudinal actuator being configured to drive the gripping element in the longitudinal direction, or one longitudinal actuator configured to move the gripping element in the longitudinal direction and one rotary actuator configured to rotate the gripping element,
- the front correction sensor module comprises at least a pair of front correction sensors aligned along a lateral direction and transversely spaced between them,
- the register comprises at least one lateral correction sensor configured to measure the lateral position of a register mark printed on a lateral section of the plate-like element grasped by the gripping element.

The invention also relates to a processing machine for processing plate-like elements wherein the processing machine comprises:

- a conveyor for conveying a plurality of plate-like elements in a longitudinal direction, the conveyor having a plurality of gripper bars;
- a register as described previously, including a gripping element for placing the plate-like elements in the plurality of gripper bars of the conveyor,
- a computation and control unit configured to
  - receive measurements from the front pre-correction sensor module to control the actuator module in order to move the gripping element and grasp a plate-like element,
  - receive measurements from the front correction sensor module to control the actuator module in order to move the gripping element toward the gripper bar.

The invention also relates to a method for placing plate-like elements within a processing machine as described previously, wherein the method for placing plate-like elements comprises the successive steps of:

- advancing the plate-like elements in a downstream longitudinal direction, and
- during the advancement of each plate-like element:
  - determining at least a longitudinal placement error and an angular placement error of the plate-like element relative to a theoretical position, by detecting the passage of a front transverse edge of the plate-like element by the front pre-correction sensor module at a first lateral axis of detection or at a second lateral axis of detection, located longitudinally downstream of the first lateral axis of detection;
  - controlling the gripping element according to the measured longitudinal placement error and the measured angular placement error at the first lateral axis of detection or at the second lateral axis of detection if the front transverse edge of the plate-like element has not been detected at the first lateral axis of detection to grasp the plate-like element;
  - then measuring at least the longitudinal placement error and the transverse placement error of the plate-like element grasped by the gripping element relative to a theoretical position, by detecting register marks printed on the plate-like element by the front correction sensor module at a third lateral axis of detection; and controlling the moving of the gripping element toward the gripper bar according to the measured placement errors of the plate-like element.

Further advantages and features will become apparent from the description of the following figures, which are given by way of no limiting example:

DESCRIPTION OF EMBODIMENTS

Figure 1:
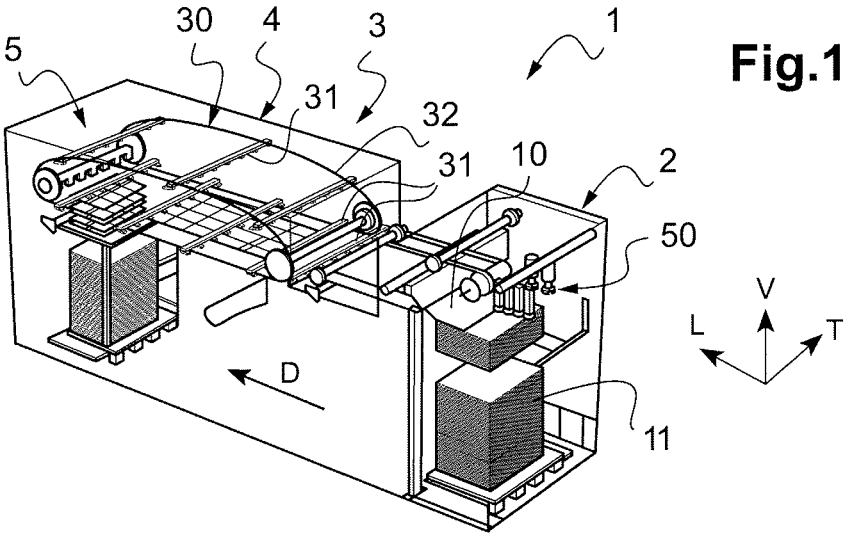
FIG. 1 is a schematic representation of a first type of processing machine.

For reasons of clarity, the same elements have been given identical reference numerals. Similarly, only the elements essential to the understanding of the invention have been illustrated, in a schematic manner and without being to scale.

The longitudinal, vertical and transverse (or lateral) directions are indicated in FIG. 1 by the orthogonal spatial system (L, V, T).

Figure 7:
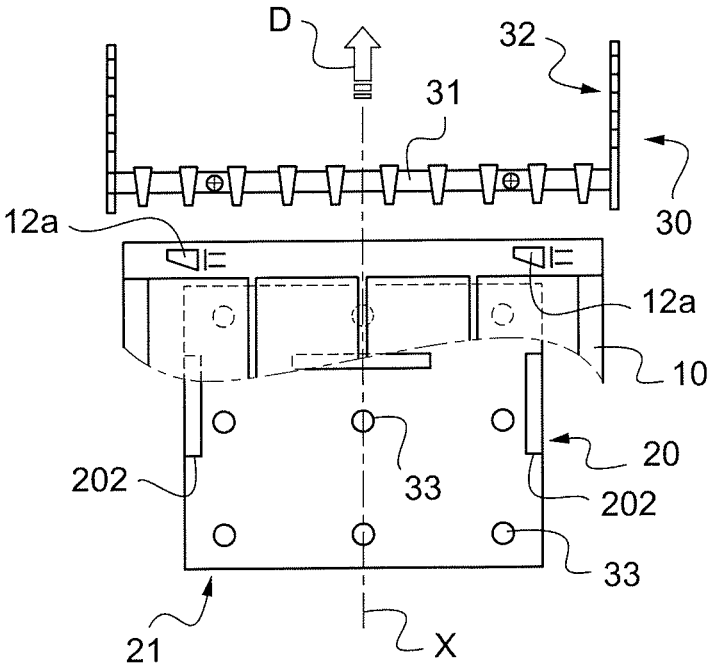
FIG. 7 is a schematic plan view of the front transverse edge of a plate-like element grasped by a suction plate of the second type of processing machine, moving in the direction of a gripper bar in order to be grasped by the latter.
Figure 8:
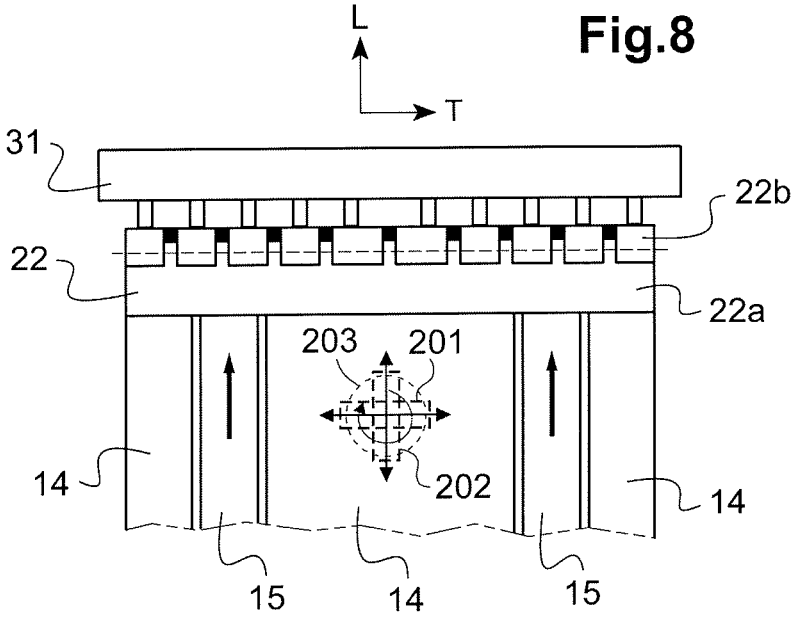
FIG. 8 illustrates a feeder station showing the rotary actuator.

The terms "upstream" and "downstream" are defined with reference to the direction of movement of plate-like elements 10, in the longitudinal direction L as illustrated by the arrow D in FIGS. 1 and 7. These plate-like elements move from upstream to downstream, generally following the main axis of the machine in the longitudinal direction L, for example in a movement paced by periodic stops. The adjectives "longitudinal" and "lateral" are defined with respect to this main axis. The terms "plate-like elements" and "sheets" are equivalent, and relate both to elements comprising corrugated cardboard and flat cardboard or paper or any other material routinely used in the packaging industry.

FIG. 1 shows a schematic overview of a first embodiment of a processing machine 1, such as a die press, in which the method for placing plate-like elements 10, such as sheets, can be applied.

The processing machine 1 comprises a series of processing stations typically including a feeder station 2 followed by a punching station 3, a waste ejection station 4 and a reception station 5. The number and nature of processing stations may vary depending on the nature and the complexity of the converting operations to be carried out on the plate-like elements 10.

In the feeder station 2, these plate-like elements 10 are placed in a stack 11, taken from the top of the stack 11, placed in the form of an overlapping or shingled stream and then conveyed to a feed board 14 before being inserted by a register 60 into a plurality of gripping members of a gripper bar 31 of a conveyor 30 of the processing machine 1, the conveyor 30 conveying the plate-like elements 10 in a paced flow into the successive stations 3, 4, 5.

More precisely, the conveyor 30 comprises for example two loops of chains 32. Between the loops of chains, a plurality of transverse bars equipped with grippers, commonly known as gripper bars 31, is arranged; each in turn is used to grasp a plate-like element 10 at its front edge.

The loops of chains 32 move and stop periodically. During a movement, each gripper bar 31 is passed from one station to the adjacent downstream station. The position of the stops of the gripper bars 31 are dictated by the loops of chains 32 which move at each cycle of a constant distance. This distance corresponds to the theoretical pitch of these gripper bars 31 on the loops of chains 32. The processing stations 2, 3, 4 and 5 are fixed and separated by this same pitch so that, at each stop, the gripper bars 31 stop in register with the tools at these stations.

The movement of the gripper bars 31 describes a cycle corresponding to the transfer of a plate-like element 10 from one station to the next station. Each station performs its work in synchrony with this cycle that is commonly known as the machine cycle. The movements, accelerations, speeds, forces are often represented on a curve corresponding to a machine cycle, with an abscissa value varying between 0° and 360°. An abscissa value on this kind of curve is commonly known as the press angle (AM).

Figure 2:
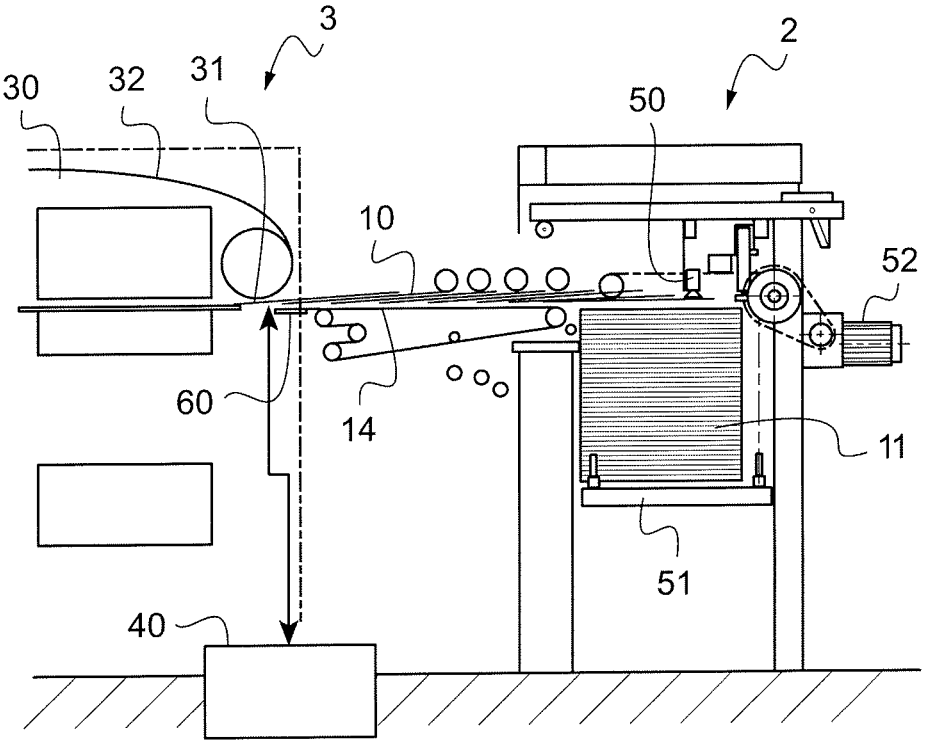
FIG. 2 shows the feeder station of the first type of processing machine of FIG. 1.

The devices for placing the plate-like element 10 in an overlapping stream and for conveying the overlapping stream are shown in greater detail in FIG. 2. The stack 11 is converted into an overlapping stream by the sucker unit 50, the top of the stack 11 being kept at a constant level by virtue of the raising of the stack-holder tray 51 driven by a motor 52. The plate-like element 10 on the top of the stack 11 is picked up from the back or trailing part and then pushed forward by the sucker unit 50 so as to form the overlapping stream, and the front portion of the plate-like element 10 sliding beneath the previous plate-like element 10.

The plate-like elements 10 of the overlapping stream are precisely placed longitudinally and laterally by the register 60 of the processing machine 1, making it possible to place the plate-like elements 10 in the gripper bar 31 which conveys them in a paced flow into successive stations 3, 4, 5. The placement of the plate-like elements 10 that form the overlapping stream occurs at the end of the feed board 14 located next to the conveyor 30 of the punching station 3, by using a sophisticated system that does not require the plate-like elements 10 to stop.

The register 60 comprises a gripping element connected to the feed board 14, for grasping and placing the plate-like elements 10 in the grippers bar 31. In the first embodiment shown in FIG. 1 to FIG. 3, the gripping element comprises two transverse bars 22*a*, 22*b*. The transverse bars 22*a*, 22*b* are connected to the feed board 14 so that when a plate-like element 10 arrives, conveyed by the belts 15 of the feed board 14, it passes between both transverse bars 22*a*, 22*b*. The upper transverse bar 22*a* is movable toward the lower transverse bar 22*b* so that the gripping element may move between an open position and a closed position for which the transverse bars 22*a*, 22*b* grasp a plate-like element 10. This gripping element is commonly known as a pincers bar 22, the function of which is to grasp a plate-like element 10 at its front transverse edge in order to convey it into the gripper bar 31 depending on its initial starting position.

The register 60 also comprises an actuator module configured to move the pincers bar 22.

It may be configured to drive the transverse bars 22*a*, 22*b* of the pincers bar 22 in a lateral direction relative to the longitudinal direction and in the longitudinal direction and to rotate the transverse bars 22*a*, 22*b* of the pincers bar 22. In this first embodiment, the actuator module is also configured to activate the opening and closing of the pincers bar 22.

In a first example, the actuator module comprises a lateral actuator 201, such as a linear motor, configured to drive the pincers bar 22 along a lateral direction relative to the longitudinal direction.

The actuator module also comprises two longitudinal actuators 202 that are also realized by linear motors, spaced between them in the lateral direction, each longitudinal actuator 202 being configured to move the pincers bar 22 in the same longitudinal direction. When the two longitudinal actuators 202 receive different signals, they cause the pincers bar 22 to rotate about an axis perpendicular to the surface of the feed board 14 attached to the pincers bar 22 that supports the plate-like element 10.

As an alternative to the two longitudinal actuators 202, the actuator module may comprise only one longitudinal actuator 202, such as a linear motor, configured to move the pincers bar 22 in longitudinal direction and one rotary actuator 203 configured to rotate the pincers bar 22 about an axis perpendicular to the surface of the feed board 14.

Figure 3:
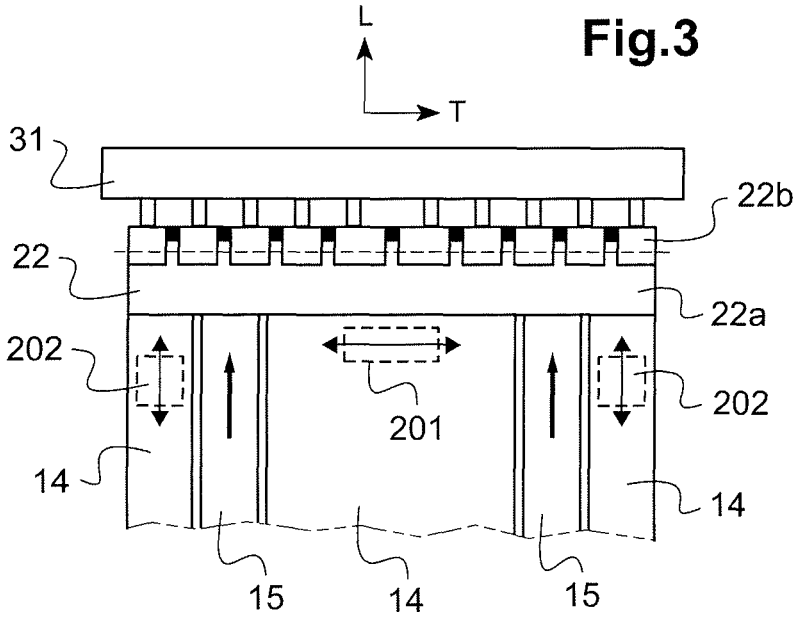
FIG. 3 shows a register of the feeder station of FIG. 2 with a pincers bar positioned in parallel to a gripper bar.

The actuator module can be arranged under the feed board 14 (in dotted lines in FIG. 3).

The actuator module is controlled to drive the pincers bar 22 according to a trajectory that depends on the initial position of the plate-like element 10. This initial position is measured by sensors of the register 60.

Figure 5E:
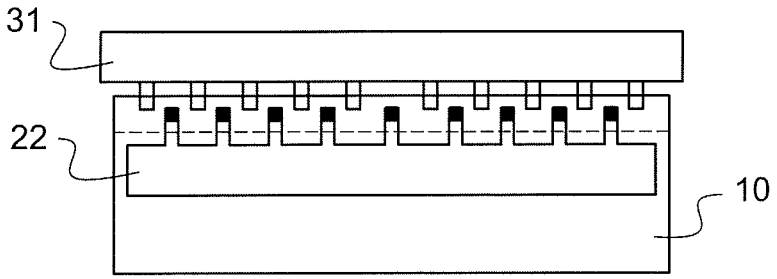
FIGS. 5A to 5E represent schematically the use of the method for placing plate-like elements in a processing machine.
Figure 5D:
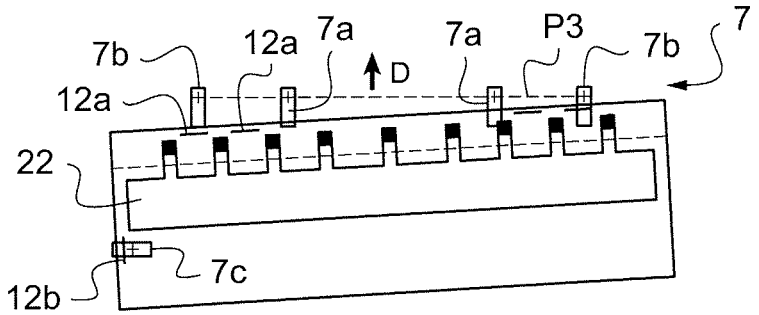

The register 60 comprises at least one front correction sensor module 7 configured to measure the front position of register marks 12*a*, printed on a front section of the plate-like element 10 when the plate-like element 10 is moving, grasped by the pincers bar 22, in order to carry out a longitudinal, lateral and angular alignment (FIG. 5D).

Such register marks 12*a* are printed on the front portion of the plate-like element 10, usually on the front waste section 13 that is used by the gripper bar 31 to hold the plate-like element 10. Register marks 12*b* may also be printed on the lateral portion of the plate-like element 10, notably in order to measure the lateral position of the plate-like element 10, in order to carry out the lateral alignment.

The front correction sensor module 7 may comprise at least one pair of front correction sensors 7*a* aligned along a third lateral axis of detection P3 with respect to the longitudinal direction and spaced from one another, making it possible to measure at the same time the longitudinal placement error and the angular placement error of the plate-like element 10.

For example, the front correction sensor module 7 comprises at least a first pair of front correction sensors 7*a* having a first distance between them, such as comprised between 100 millimeters and 1000 millimeters. The front correction sensor module 7 may comprise also a second pair of front correction sensors 7*b* presenting a second distance between them that is bigger than the first distance, such as comprised between 500 millimeters and 1500 millimeters. The second distance may be the double of the first distance.

The register 60 may also comprise at least one lateral correction sensor 7*c* configured to measure the lateral position of a register mark 12*b* printed on a lateral section of the plate-like element 10 grasped by the pincers bar 22.

The correction sensors 7*a*, 7*b*, 7*c* may be optical sensors, such as cameras, configured to measure the light intensity reflected by the surface of the plate-like element 10. They may be accurate sensors that have a high sensitivity adapted to measure the position of the register marks 12*a*, 12*b* printed on plate-like element 10 presenting different media or colours.

The lateral correction sensor 7*c* may be able to detect the register marks 12*b* on a larger area than the front correction sensors 7*a*, 7*b*. It is for example a curtain sensor, for example able to detect the register mark 12*b* through an area defined by an array of sensing beams.

Each correction sensors 7*a*, 7*b*, 7*c* can be doubled. One is placed above the plane of passage of the plate-like elements 10 and another is placed below. By virtue of this arrangement, it becomes possible to read the printed marks 12*a*, 12*b* made either above or under the plate-like element 10. For example, it allows registering the mark 12*a*, 12*b* of plate-like elements 10 conveyed backwards, such as for large plate-like element 10 allowing facilitating its passage through the stations.

The register 60 may also comprise lighting devices, for example as many lighting devices as correction sensors 7*a*, 7*b*, 7*c*, typically of the LED type, placed so as to light the register marks 12*a*, 12*b* in order to improve the measurements taken by the correction sensors 7*a*, 7*b*, 7*c*. The lighting devices may advantageously be incorporated into the correction sensors 7*a*, 7*b*, 7*c* which provide advantages in terms of space requirement, of ease of mechanical installation and adjustment, but also in terms of maintenance.

As the front correction sensor module 7 is able to measure register marks 12*a* printed on the plate-like element 10, it can also detect the passage of a front transverse edge of the plate-like element 10.

The register 60 also comprises at least one front pre-correction sensor module 80 (FIG. 5B), placed upstream of the front correction sensor module 7, in the longitudinal direction.

The front pre-correction sensor module 80 is configured to detect the passage of a front transverse edge of the plate-like element 10 in at least two longitudinally spaced lateral axes of detection P1, P2, one located in front of the other, when the plate-like element 10 is in moving but before it is grasped on the fly by the pincers bar 22.

The front pre-correction sensor module 80 may be of extremely simple construction.

For example, the front pre-correction module 80 comprises at least one optical sensor comprising a beam emitter and a beam receptor, for example detecting a breaking of a light beam by the plate-like element 10 passage to detect the passage of the front transverse edge. As an alternative, the optical sensor may comprise only a beam receptor to detect the light reflected by the plate-like element 10 to detect the passage of the front transverse edge.

It is thus a simple on-off sensor, only able to indicate the presence or the absence of a plate-like element 10. These kinds of sensors are cheap, commercially available and present low footprints.

For example, the pre-correction sensor module 80 comprises at least a first front pre-correction sensor module 8 being placed upstream of the front correction sensor module 7 in the longitudinal direction and at least a second front pre-correction sensor module 9 being placed upstream of the first front pre-correction sensor module 8 in the longitudinal direction.

For example, the first front pre-correction sensor module 8 comprises at least a pair of first front pre-correction sensors 8*a*, 8*b* and the first front pre-correction sensor module 9 comprises at least a pair of second front pre-correction sensors 9*a*, 9*b*.

The two first front pre-correction sensors 8*a*, 8*b* are aligned along the second lateral axis of detection P2 with respect to the longitudinal direction and spaced from one another, making it possible to measure at the same time the longitudinal placement error and the angular placement error of the plate-like element 10. The two first front pre-correction sensors 8*a*, 8*b* may be spaced in the lateral direction by a distance comprised between 100 millimeters and 1000 millimeters. For example, the two first front pre-correction sensors 8*a*, 8*b* are each fixed to a respective front correction sensor 7*a*, 7*b* of a pair, positioned upstream with respect to the front correction sensor 7*a*, 7*b*. The two first front pre-correction sensors 8*a*, 8*b* could be fixed between the two front correction sensors 7*a*, 7*b*.

The two second front pre-correction sensors 9*a*, 9*b* are aligned along the first lateral axis of detection P1 with respect to the longitudinal direction and spaced from one another, making it possible to measure at the same time the longitudinal placement error and the angular placement error of the plate-like element 10. The two second front pre-correction sensors 9*a*, 9*b* may be spaced in the lateral direction by a distance comprised between 100 millimeters and 1000 millimeters. For example, the two second front pre-correction sensors 9*a*, 9*b* are each fixed to a respective first front pre-correction sensor 8*a*, 8*b* of a pair, positioned upstream with respect to the first front pre-correction sensor 8*a*, 8*b*. The two second front pre-correction sensors 9*a*, 9*b* could be fixed between the two first front pre-correction sensors 8*a*, 8*b*.

Figure 4:
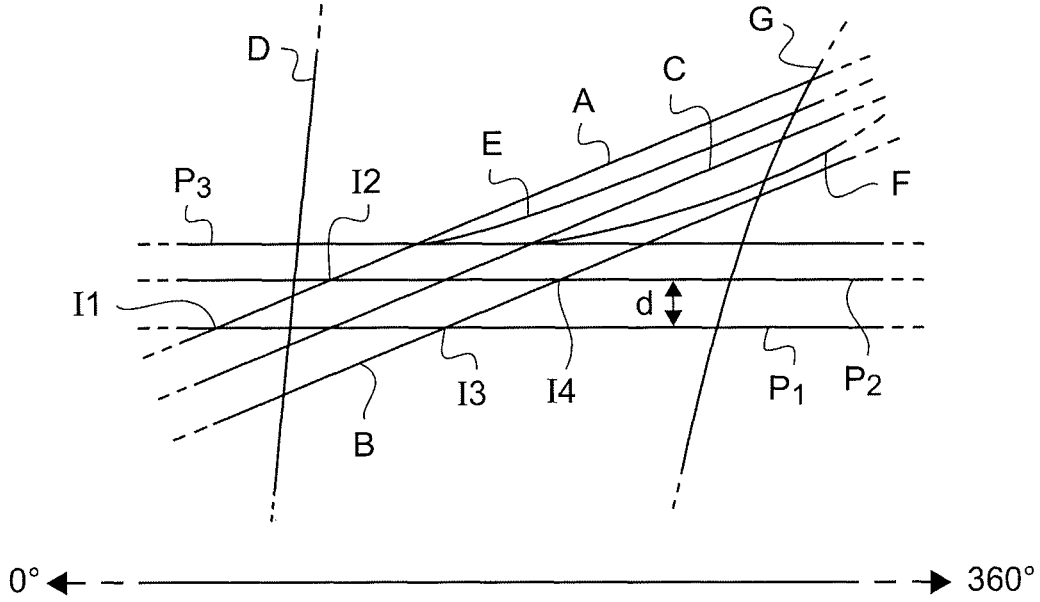
FIG. 4 is a graphic showing movements of plate-like elements, gripper bar and pincers bar, during a machine cycle, with the press angle (AM) in x-axis and the distance in y-axis.
Figure 5C:
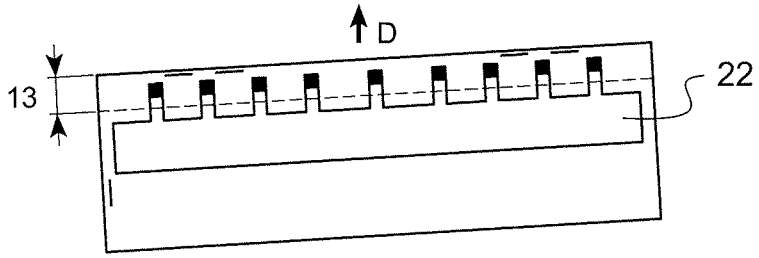
Figure 5B:
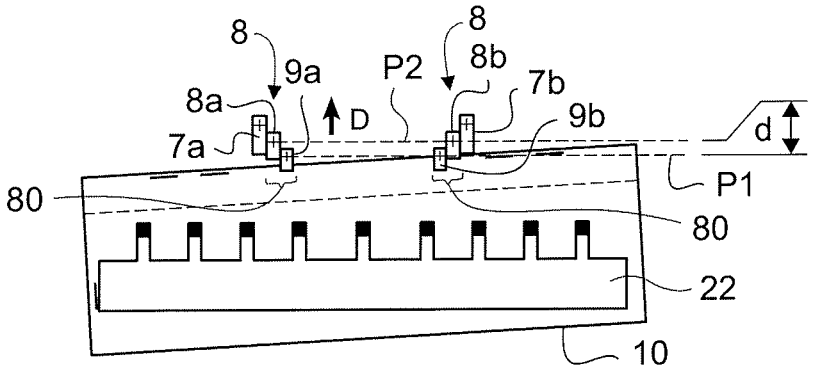

The distance d between the first lateral axis of detection P1 and the second lateral axis of detection P2, longitudinally spaced, that is as in this example, between the light beam of the first front pre-correction sensor 8*a*, 8*b* and the light beam of the second front pre-correction sensor 9*a*, 9*b*, may be comprised between 2 mm and 30 mm (FIGS. 5*b* and 4).

In another example not represented, the front pre-correction sensor module 80 is a light curtain sensor, able to detect the passage of a front transverse edge of the plate-like element 10 in at least two longitudinally spaced lateral axis of detection P1, P2, one located in front of the other, and therefore into a light curtain of for example 2 mm to 30 mm wide.

In the first embodiment, the front pre-correction sensor module 80 and the front correction sensor module 7 may be arranged between the transverse bars 22*a*, 22*b* of the pincers bar 22, above the lower transverse bar 22*b* and facing downwards, so that when a plate-like element 10 arrives between the transverse bars 22*a*, 22*b*, supported by the lower transverse bar 22*b*, it can be detected by the front pre-correction sensor module 80 and the front correction sensor module 7.

The register 60 also comprises a computation and control unit 40, of the microprocessor or microcontroller type.

The computation and control unit 40 is configured to receive measurements from the front correction sensor module 7, the lateral correction sensor 7*c* and the front pre-correction sensor module 80 and to control the actuator module in order to move the pincers bar 22 toward the gripper bar 31 and to activate the pincers bar 22 in order to grasp a plate-like element 10.

An example of a method for placing plate-like elements 10, in the processing machine 1, is described in reference to FIG. 4 and to FIGS. 5A to 5E.

Figure 5A:
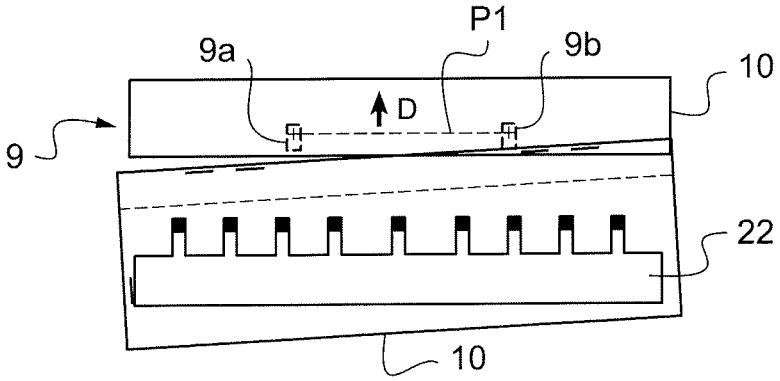

In FIG. 5A, a plate-like element 10 is presented between the transverse bars 22*a*, 22*b* of the pincers bar 22 with a considerable angular positioning error and an insignificant longitudinal placement error.

In a first step, during the advancement of each plate-like element 10 in a downstream longitudinal direction, before being grasped by the pincers bar 22, at least longitudinal and angular placement errors of the front transverse edge of the plate-like element 10, relative to a theoretical position, are determined by detecting a front transverse edge of the plate-like element 10, by the front pre-correction sensor module 80 at the first lateral axis of detection P1 or at the second lateral axis of detection P2, located longitudinally downstream of the first lateral axis of detection P1.

The graphic in FIG. 4 shows two exemplary trajectories of a plate-like element 10 during a machine cycle, a first one moving in advance (curve A) and a second one moving with a delay (curve B) with respect to the optimum trajectory of a plate-like element 10 moving in time (curve C).

During the advance of the plate-like element 10 in the longitudinal direction, in the case of the plate-like element 10 arriving at the first lateral axis of detection P1 in advance (curve A), at I1° AM, the second front pre-correcting sensors 9*a*, 9*b* are not able to detect the passage of the front transverse edge of the plate-like element 10 because the plate-like element 10 is hidden by the plate-like element 10 located upstream (curve D) just leaving the place (FIG. 5A).

However, after few ° AM, the plate-like element 10 located upstream has left, uncovering therefore the front transverse edge of the plate-like element 10. At least one of the first front pre-correcting sensors 8*a*, 8*b* placed upstream of the second front pre-correction sensors 9*a*, 9*b*, at the second lateral axis of detection P2, is therefore able to detect the passage of the front transverse edge of the plate-like element 10, at the distance d later, at I2° AM, in the hole between the two successive plate-like elements 10 (FIG. 5B).

In the case of a plate-like element 10 arriving at the first lateral axis of detection P1 with a delay (curve B), at least one of the second front pre-correction of sensors 9*a*, 9*b* is able to detect the passage of the front transverse edge of the plate-like element 10 at I3° AM. The first front pre-correction sensors 8*a*, 8*b* are also able to detect the passage of the front transverse edge of the plate-like element 10, at the distanced later, at I4° AM.

Therefore, the front pre-correction sensor module 80 is adapted to detect the passage of a front transverse edge of the plate-like element 10 in advance in a hole of plate-like elements 10, for a plate-like element 10 being late, in time or in advance.

When the measurements are taken by the front pre-correction sensor module 80, that is to say by the first pre-correction sensors 8*a*, 8*b* in case of plate-like elements 10 in advance or by the second pre-correction sensors 9*a*, 9*b* in case of plate-like elements 10 in time or late, these measurements are immediately transmitted to the computing and control unit 40 for the computation of the position of the front transverse edge of the plate-like element 10 and of the trajectory of the pincers bar 22.

The control unit 40 is programmed with software in order to compute the values of the movement parameters (longitudinal or askew) of the pincers bar 22 for controlling the pincers bar 22 according to the measured longitudinal and angular placement errors at the first lateral axis of detection P1 or at the second lateral axis of detection P2 if the front transverse edge of the plate-like element 10 could not have been detected at the first lateral axis of detection P1, and for starting the displacement of the pincers bar 22.

A transit time is determined by the computation and control unit 40 by virtue of the measurements sent by the front pre-correction sensor module 80. The computation and control unit 40 then computes the placement errors knowing the displacement speed. Then, the control unit 40 controls the pincers bar 22 by sending control signals to the longitudinal actuators 202 to correct these longitudinal and angular placement errors in order to ensure a perfect placement of the front transverse edge of the plate-like element 10 in the pincers bar 22.

Therefore when the plate-like element 10 is in advance (curve A) and detected at I2° AM, the pincers bar 22 can start slightly after I2° AM, moving in advance (curve E). In the case of a plate-like element 10 arriving with a high delay (curve B) and detected at the earlier at I3° AM, the pincers bar 22 can also start to move in advance but later, slightly after I3° AM (curve F). In both cases, the pincers bar 22 is driven to be placed parallel to the plate-like element 10 (curves E, F). In both cases, the passage of the front transverse edge of the plate-like element 10 is detected earlier by the front pre-correction sensor module 80, and for both cases, the pincers bar 22 can be started in advance to be placed correctly before grasping the plate-like element 10 early enough allowing avoiding excessive accelerations and vibrations of the pincers bar 22.

The pincers bar 22 is thus controlled according to the measured longitudinal placement error and the measured angular placement error at the first lateral axis of detection P1 or at the second lateral axis of detection P2 if the front transverse edge of the plate-like element 10 has not being detected at the first lateral axis of detection P1 to grasp the plate-like element 10.

FIG. 5C represents the moment when the pincers bar 22 grasps the plate-like element 10. Since the pincers bar 22 has been controlled according to the measured placement errors, the pincers bar 22 seizes the plate-like element 10 on the fly by pinching it precisely in the front waste section 13, which is parallel to the transverse bars of the pincers bar 22.

Then, in a second step, the longitudinal placement error, the transverse placement error and the angular placement error of the plate-like element 10 grasped by the pincers bar 22, relative to a theoretical position, are measured by detecting register marks 12*a*, 12*b* printed on the plate-like element 10 by the front correction sensor module 7 at a third lateral axis of detection P3 and by the lateral correction sensor 7*c*.

The front correction sensor module 7 and the lateral correction sensor 7*c* measure the intensity of the light reflected by the surface of the plate-like element 10 when it is illuminated by a lighting device, in a predetermined zone in which the register marks 12*a*, 12*b*, are located. Processing of the signal obtained then makes it possible to compute the position of the register marks 12*a*, 12*b*. FIG. 5D represents schematically the measurement of the lateral, longitudinal and angular placement errors of the plate-like element 10 by virtue of the front correction sensor module 7 and lateral correction sensor 7*c*.

When the measurements are taken by the front correction sensor module 7 and the lateral correction sensor 7*c*, these measurements are immediately transmitted to the computing and control unit 40 for the computation of the position of the register marks 12*a*, 12*b*. The computation and control unit 40 computes lateral, longitudinal and angular placement errors according to these measurements and according theoretical positions that the plate-like element 10 should have when grasped by the pincers bar 22 and computes the trajectory of the pincers bar 22.

Then, the computation and control unit 40 controls the pincers bar 22 according to the measured placement errors of the plate-like element 10, by sending control signals to the lateral actuator 201 and to the longitudinal actuators 202 to move the pincers bar 22 so as to correct these lateral, longitudinal and angular placement errors in order to ensure perfect placement of the front transverse edge of the plate-like element 10 in the gripper bar 31. FIG. 5E represents schematically the placement of the plate-like element 10, the transverse bars 22*a*, 22*b* of the pincers bar 22 being positioned in parallel with the transverse bar of the gripper bar 31.

Knowing the theoretical stopping position of the gripper bar 31 in the feeder station 2 (curve G), the control unit 40 is configured for computing the values of the movement parameters (lateral, longitudinal or askew) of the pincers bar 22 so that the latter correctly brings the plate-like element 10 it is conveying into the gripper bar 31.

Once the plate-like element 10 has been transferred to the gripper bar 31, the pincers bar 22 returns to its starting position and waits for the passage of a new plate-like element 10.

The plate-like element 10 will then be conveyed by the gripper bar 31 into the punching station 3 where it will be punched according to a die corresponding to the opened-out shape that it is desired to obtain, for example for the purpose of obtaining a plurality of boxes of a given shape. In this station, or in one or more subsequent stations, other operations can also be carried out such as the scoring of fold lines, the embossing of certain surfaces and/or the placing of motifs from metalized strips for example.

All these steps should occur during the advancement of each plate-like element 10. This means in particular that this plate-like element 10 is seized on the fly by the pincers bar 22, without stopping, and that the measurements, the pre-corrections and the corrections are also carried out during this advancement. Thus the plate-like element 10 never ceases to advance, which makes it possible to achieve very high processing rates, for example of the order of 12000 sheets per hour.

Figure 6:
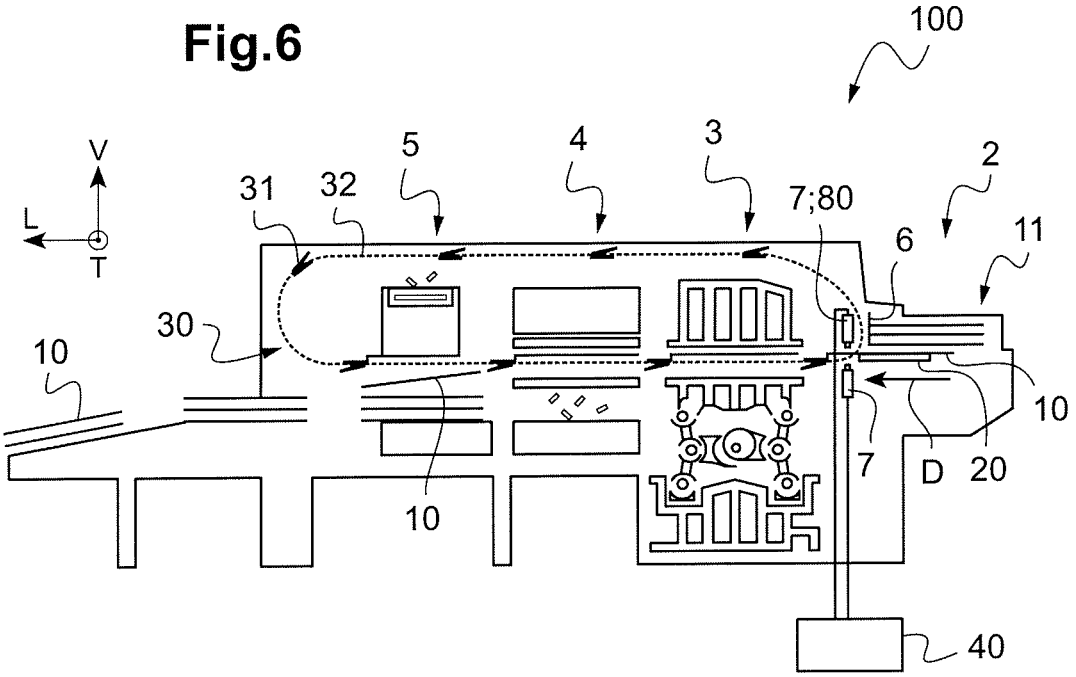
FIG. 6 is a schematic representation of a second type of processing machine.

FIG. 6 shows a schematic overview of a second embodiment of a processing machine 100 in which the method for placing plate-like elements 10 can be applied. This processing machine 100 comprises, as the processing machine 1 of the first embodiment, a series of processing stations typically including a feeder station 2 followed by a punching station 3, a waste ejection station 4 and a reception station 5.

In the feeder station 2, these plate-like elements 10 are placed in a stack 11 which rests notably against a gauge 6 also used as a front stop for these elements. By virtue of the interstice or gap left at the bottom of the gauge 6, these elements can be withdrawn one by one from the bottom of the stack 11 and then, transferred to a register 20 according a second embodiment.

FIG. 7 shows, in a schematic view from above, a front section of a plate-like element 10 being moved toward a gripper bar 31 by the register 20. In the example of the processing machine 100 shown in FIG. 6, the gripping element of the register 20 comprises a plurality of suckers 33 arranged in a suction plate 21. When vacuum is provided in the suckers 33, the activated suction plate 21 grasps a plate-like element 10 by sucking it from the bottom of the stack 11. This will cause the plate-like element 10 to slide beneath the gauge 6 and bring it into a determined position in engagement with the gripper bar 31 of the conveyor 30.

In this second embodiment, the suction plate 21 is controlled in order that the front transverse edge of the plate supporting the plate-like element 10 is positioned in parallel to the transverse bar of the gripper bar 31 to correctly bring the plate-like element 10 into the gripper bar 31.

The invention claimed is:

1. A register for a processing machine for processing plate elements comprising:

a gripping element configured for placing the plate elements on a gripper bar of a conveyor of a processing machine for conveying the plate elements in a longitudinal direction;

an actuator module configured to drive the gripping element;

at least one front correction sensor module configured to measure the front position of register marks located on a front section of the plate element that is grasped by the gripping element;

at least one front pre-correction sensor module, located upstream of the front correction sensor module in the longitudinal direction of conveying the plate elements, the front pre-correction sensor module being configured:

to detect the passage of a front transverse edge of each of the plate elements in at least two longitudinally spaced apart, lateral axes of detection, one axis located in front of the other; and to provide measurements to a computation and control unit of the processing machine and the computation and control unit is configured:

to control the actuator module in order to move the gripping element toward the gripper bar; and to activate the gripping element in order to grasp a plate element.

2. A register according to claim 1, wherein the distance between the first lateral axis of detection and the second lateral axis of detection longitudinally spaced one in front of the other, is between 2 mm and 30 mm.

3. A register according to claim 1, further comprising:

at least a first front pre-correction sensor located upstream of the front correction sensor module in the longitudinal direction;

at least a second front pre-correction sensor located upstream of the first front pre-correction sensor in the longitudinal direction.

4. A register according to claim 3, further comprising:

the first front pre-correction sensor comprises a least a pair of first front pre-correction sensors aligned along the lateral direction and spaced from one another; and the second front pre-correction sensor comprises at least a pair of second front pre-correction sensors aligned along the lateral direction and spaced from one another.

5. A register according to claim 3, wherein each of the pre-correction sensors comprises at least one optical sensor including at least one light beam receiver.

6. A register according to claim 1, wherein the actuator module comprises:

a lateral actuator configured to drive the gripping element along a selected lateral direction relative to the longitudinal direction; and two longitudinal actuators spaced apart in the lateral direction, each longitudinal actuator configured to drive the gripping element in a selected longitudinal direction, or one longitudinal actuator configured to move the gripping element in the selected longitudinal direction; and a rotary actuator configured to rotate the gripping element around an axis transverse to both of the longitudinal and lateral directions.

7. A register according to claim 1, further comprising the front correction sensor module comprises at least a pair of front correction sensors aligned along a lateral direction and transversely spaced between them.

8. A register according to claim 7, further comprising the register comprises at least one lateral correction sensor configured to measure the lateral position of a register mark on a lateral section of the plate element which plate element is grasped by the gripping element.

9. A processing machine for processing plate elements, wherein the processing machine comprises:

a conveyor for conveying a plurality of plate elements in a longitudinal direction, the conveyor having a plurality of gripper bars conveyed by the conveyor;

a register according to claim 1, including the gripping element for placing a reflective one of the plate elements in the plurality of gripper bars of the conveyor;

the computation and control unit configured to:

receive measurements from the front pre-correction sensor module and to control the actuator module in order to move each gripping element and grasp one of the plate-like plate element; and receive measurements from the front correction sensor module to control the actuator module in order to move each gripping element toward the gripper bar.

10. A method for placing plate elements within a processing machine to claim 9, wherein the method comprises successive steps of:

advancing the plate elements in a downstream longitudinal direction, and during the advancement of each plate element:

determining at least one of a longitudinal placement error and an angular placement error of the plate element relative to a theoretical position for the plate element, by detecting the passage of a front transverse edge of the plate element by the front pre-correction sensor module at a first lateral axis of detection and/or at a second lateral axis of detection, which is located longitudinally downstream of the first lateral axis of detection in the longitudinal direction;

controlling the gripping element according to at least one of: (1) the measured longitudinal placement error and (2) the measured angular placement error at at least one of the first lateral axis of detection and at the second lateral axis of detection if the front transverse edge of the plate element has not been detected at the first lateral axis of detection to grasp the plate element;

then measuring at least one of the longitudinal placement error and the transverse placement error of the plate element grasped by the gripping element relative to a theoretical position for the plate element in the longitudinal direction, the detection being by the front correction sensor module by detecting register marks on the plate element at a third lateral axis of detection; and controlling the moving of the gripping element toward the gripper bar while correcting the measured placement errors of the plate element.

* * * * *